US005555682A

United States Patent [19]

Colitto

[11] Patent Number: 5,555,682

[45] Date of Patent: Sep. 17, 1996

[54] VINYL WINDOW FRAME WITH REMOVABLE COVERED ACCESSORY GROOVE

[75] Inventor: Domenic Colitto, Bolton, Canada

[73] Assignee: Royal Extrusions Limited, Woodbridge, Canada

[21] Appl. No.: 340,522

[22] Filed: Nov. 16, 1994

[51] Int. Cl.[6] ..... E04B 1/00; E06B 7/28

[52] U.S. Cl. ..... 52/100; 52/204.1; 52/656.5; 52/656.7

[58] Field of Search ..... 52/37, 98, 100, 52/204.1, 204.5, 204.53, 211, 656.7, 656.2, 656.5

[56] References Cited

U.S. PATENT DOCUMENTS

| | | | |
|---|---|---|---|
| 3,512,318 | 5/1970 | Turner | 52/100 |
| 4,110,942 | 9/1978 | Slocomb, Jr. | 52/100 |
| 4,330,919 | 5/1982 | Bischlipp et al. | 52/656.9 X |
| 4,856,239 | 8/1989 | Elsasser | 52/100 X |
| 5,003,747 | 4/1991 | Morton | 52/656.5 |
| 5,090,168 | 2/1992 | Fast et al. | 52/204.5 X |

*Primary Examiner*—Wynn E. Wood
*Assistant Examiner*—Kevin D. Wilkens

[57] ABSTRACT

A vinyl window frame has an accessory groove which is covered by a removable strip. When the groove is uncovered, it opens at an exposed face of the window frame. The frame includes first and second regions of weakness which facilitate removal of the strip. The first region of weakness is provided at the inside surface without penetrating through to the outside surface of the strip and the second region of weakness is provided along a side edge of the frame such that neither region of weakness is visible at the exposed face of the window frame.

1 Claim, 2 Drawing Sheets

VINYL WINDOW FRAME WITH REMOVABLE COVERED ACCESSORY GROOVE

FIELD OF THE INVENTION

The present invention relates to a vinyl window frame having an accessory groove which is covered by a removable strip.

BACKGROUND OF THE INVENTION

Many window frames are provided with grooves into which accessories can be snap fitted. This is particularly true of up to date vinyl window frames where other vinyl components having the ability to flex can be snap locked into the accessory groove.

In many of the known vinyl window frames, the accessory groove can either be permanently exposed or they may be covered by a strip which needs to be removed at the time of installation of the window. In the later case, the reason the groove remains covered is to protect against the build up of dirt and the like in the groove or to keep the groove covered if no accessories are to be fitted to the frame.

The problem encountered with existing vinyl window frames having covered accessory grooves is that the covering material is not easily removable from the frame. The installer requires a sharp knife and a good eye to determine where the covering material should be cut off of the frame.

SUMMARY OF THE INVENTION

The present invention provides a window frame made from a vinyl material and having an accessory groove covered by an easily removable strip. The groove when uncovered opens at an exposed face of the window frame. The frame includes first and second regions of weakness facilitating removal of the strip which has an inside surface directly over and an outside surface away from the groove. The first region of weakness is provided along the inside surface without penetrating through to the outside surface of the strip and the second region of weakness is provided along a side edge of the frame such that neither region of weakness is visible at the exposed face of the window frame.

When working with the window frame of the present invention, the installer is able to access the second region of weakness along the side edge of the frame to provide an initial breaking of the strip away from the frame. This then allows an easy tearing of the strip completely off of the frame at the first weakened region. If however the strip is left on the frame, there are no lines or tear strips at the exposed face of the frame which would otherwise mark its appearance.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
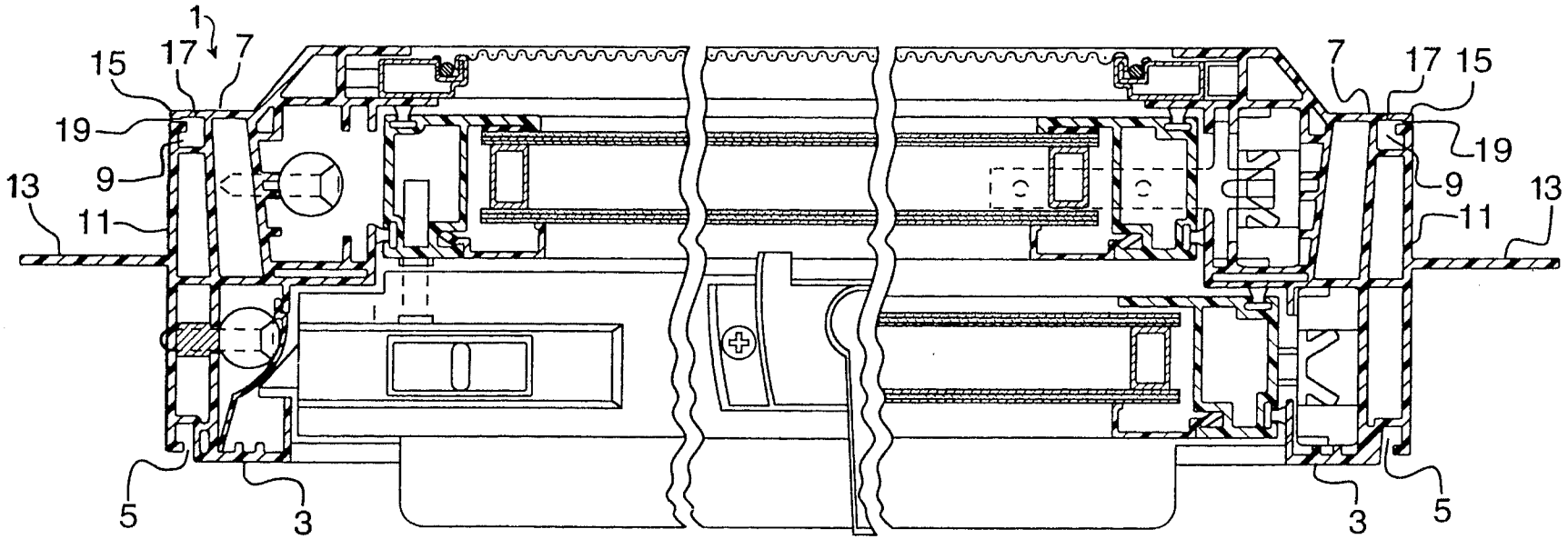
FIG. 1 a sectional view through a window frame having a removably covered accessory groove according to a preferred embodiment of the present invention.
Figure 2:
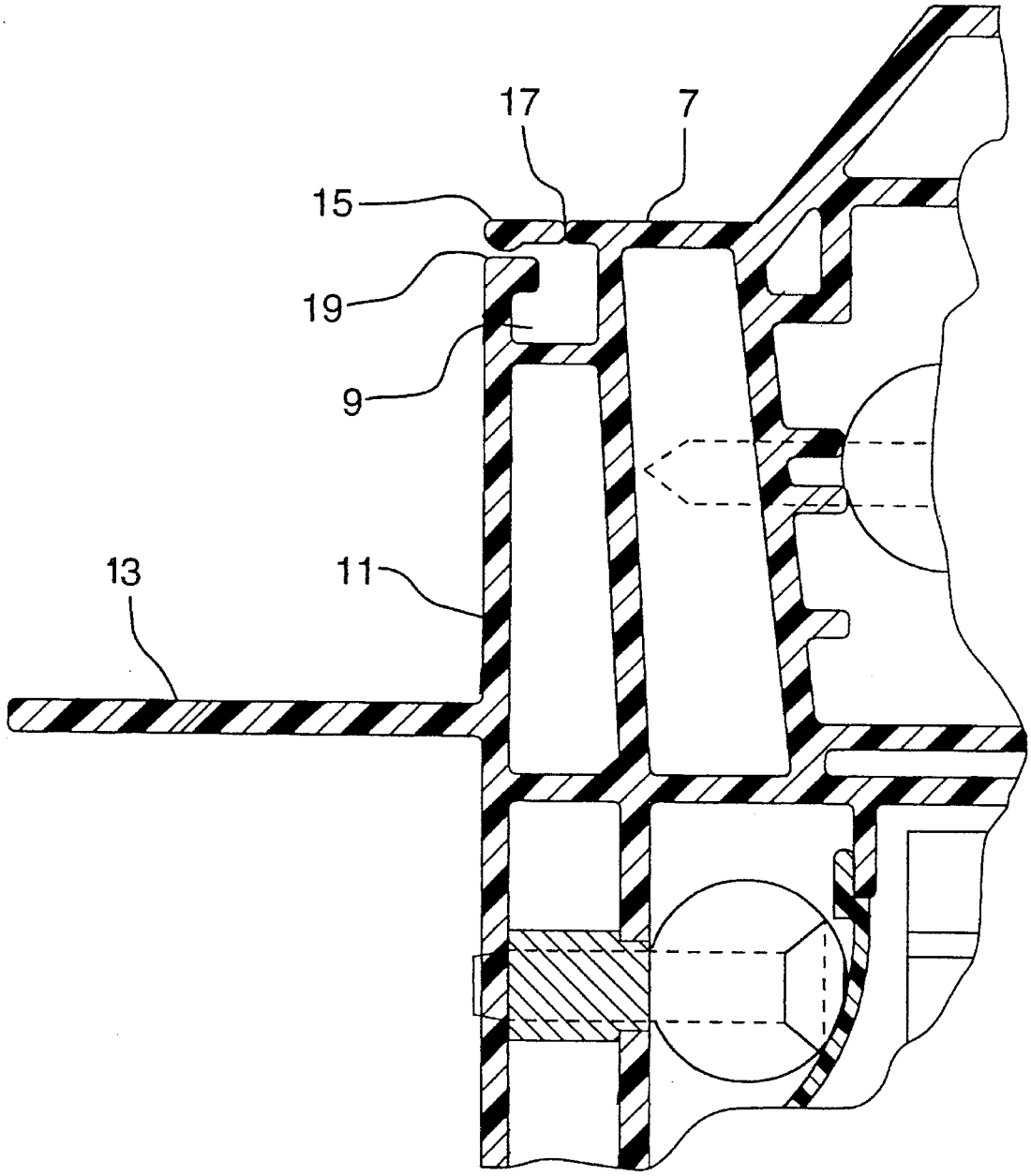
FIG. 2 is an enlarged sectional view in the area of the covered accessory groove of the window frame FIG. 1.

FIG. 1 shows a vinyl window frame generally indicated at 1. This window frame is used to support window sashes in which the actual window panes are secured. The frame itself is fitted within an opening provided in a building wall which surrounds the frame.

Frame 1 has an inside face 3 and an outside face 7. It also has side edges 11 at right angles to the two faces 3 and 7. A nailing fin 13 is provided at the side edge 11. When the window is installed in the building wall opening, face 7 is exposed to the outside of the building and face 3 is exposed to the inside of the building. The outside side edges 11 on the other hand are not exposed but rather are covered by the building wall itself.

In the particular arrangement shown the inside face 3 includes an uncovered groove 5. This groove is used to receive different type of accessories which have some type of a leg which snap lock into the accessory groove.

It is to be appreciated that although groove 5 is shown as being uncovered, it could also be covered by a removable strip the same as that found on the outside face of the window frame which is described immediately below.

The outside face 7 includes an accessory groove 9. This groove at the time of manufacturing the window frame is covered by a removable strip 15. The strip has an outside surface which is seen from the outside of the frame itself and includes an inside surface which is directly over groove 9. A preweakened region 17 runs along the length of the window. This preweakened region comprises a cut into the vinyl material at the inside surface of the strip without penetrating through to the outside surface of the frame. Therefore the cut cannot be seen from the outside facing 7 of the window frame. A second preweakened region 19 also runs along the length of the frame. This preweakened region comprises an actual cutting of the material between the strip 15 and the body which defines the outer boundaries of groove 9. As is well shown in FIG. 1, cut 19 has a lead in or mouth which is exposed at the side edge 11 without being visible from the exposed face 7 of the window frame. Accordingly, if the accessory groove 9 is not to be used, then the strip 15 can remain in place over the groove with no lines or markings whatsoever to indicate the removability of the strip which would otherwise detract from the appearance of the frame.

If the groove is to be used for receiving accessories, then the installer, before fitting the window into the building wall opening, simply pries the end of the strip away from the body of the frame through the use of a small knife or the like which is fitted into the mouth of the cut 19 along the side edge of the frame. This allows the end of the strip to be lifted away from the frame and the strip to be finally torn completely away from the frame along the preweakened region 17.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A window frame made from a plastic material, said window frame having a side edge and a front face at generally right angles to one another, said front face having an inside surface and an outside surface, said side edge being a support surface for mounting said window in a wall opening with said outside surface of said front face being exposed from the opening, said frame having an accessory groove covered by said front face which has a removable strip over said accessory groove, said frame including first and second regions of weakness facilitating removal of said strip, said first region of weakness being provided in said inside surface without penetrating through and being hidden by said outside surface of said front face and said second region of weakness being provided in and visible exteriorly along said side edge of said frame.

* * * * *